US011001071B2

(12) United States Patent
Sugawara et al.

(10) Patent No.: US 11,001,071 B2
(45) Date of Patent: May 11, 2021

(54) LIQUID EJECTION HEAD AND METHOD FOR MANUFACTURING THE SAME

(71) Applicant: CANON KABUSHIKI KAISHA, Tokyo (JP)

(72) Inventors: Takashi Sugawara, Yokohama (JP); Masafumi Morisue, Tokyo (JP); Yoshiyuki Nakagawa, Kawasaki (JP); Kazuhiro Yamada, Yokohama (JP); Takuro Yamazaki, Inagi (JP); Ryo Kasai, Tokyo (JP); Tomoko Kudo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/672,074

(22) Filed: Nov. 1, 2019

(65) Prior Publication Data

US 2020/0139703 A1 May 7, 2020

(30) Foreign Application Priority Data

Nov. 2, 2018 (JP) ..... JP2018-207265

(51) Int. Cl.
*B41J 2/175* (2006.01)
*B41J 2/14* (2006.01)
*F04B 19/00* (2006.01)

(52) U.S. Cl.
CPC ..... *B41J 2/17596* (2013.01); *B41J 2/14072* (2013.01); *F04B 19/006* (2013.01); *B41J 2002/14491* (2013.01); *B41J 2202/12* (2013.01)

(58) Field of Classification Search
CPC ..... B41J 2/17596
See application file for complete search history.

(56) References Cited

U.S. PATENT DOCUMENTS

| | | | | |
|---|---|---|---|---|
| 8,876,242 | B2 | 11/2014 | Tamaru et al. | |
| 9,248,647 | B2 | 2/2016 | Iwanaga et al. | |
| 2012/0312689 | A1* | 12/2012 | Sugioka | F04B 19/006 204/600 |
| 2013/0146459 | A1* | 6/2013 | Bazant | B03C 5/005 204/454 |
| 2015/0070446 | A1* | 3/2015 | Taff | B41J 2/17596 347/85 |
| 2019/0023016 | A1 | 1/2019 | Nakagawa et al. | |
| 2019/0023018 | A1 | 1/2019 | Nakagawa et al. | |
| 2019/0092019 | A1* | 3/2019 | Kasai | B41J 2/162 |
| 2020/0009864 | A1 | 1/2020 | Morisue et al. | |

FOREIGN PATENT DOCUMENTS

WO 2013/130039 A1 9/2013

* cited by examiner

*Primary Examiner* — Shelby L Fidler
(74) *Attorney, Agent, or Firm* — Venable LLP

(57) ABSTRACT

A liquid ejection head includes a pair of electrodes disposed on a first surface of a substrate forming part of a flow path for a liquid. The electrodes of the pair of electrodes are adjacent to each other in a transverse direction of the electrodes, and the liquid moves in the transverse direction upon application of a voltage across the electrodes. The electrodes each include a ridge portion disposed on the first surface and an electrode wiring line connected to a power source for applying the voltage. The electrode wiring line covers an upper surface of the ridge portion and side surfaces of the ridge portion and extends from parts covering the side surfaces of the ridge portion to a downstream side and an upstream side with respect to a direction in which the liquid moves, so as to cover the first surface.

10 Claims, 9 Drawing Sheets

LIQUID EJECTION HEAD AND METHOD FOR MANUFACTURING THE SAME

BACKGROUND OF THE INVENTION

Field of the Invention

The present invention relates to a liquid ejection head and a method for manufacturing the liquid ejection head.

Description of the Related Art

In liquid ejection heads for ejecting ink, vaporization of volatile components in ink through ejection orifices for ejecting ink may increase the viscosity of the ink near the ejection orifices. This changes the ejection speed of ink droplets ejected from the ejection orifices or affects ink droplet landing precision. In particular, the viscosity of ink markedly increases when the suspension time from ink ejection to the next ink ejection is long. As a result, ink solid components stick to near the ejection orifices, and the sticking ink solid components may increase ink fluid resistance to cause ink ejection failure.

There is known a method for causing fresh ink to flow from ejection orifices in a pressure chamber as a measure against such a thickening phenomenon where the ink viscosity increases. One of specific methods for causing ink to flow is a method of using a micropump that generates an alternating current electroosmotic flow (hereinafter referred to as ACEO) as disclosed in International Publication No. WO2013/130039.

SUMMARY OF THE INVENTION

A liquid ejection head of the present invention includes a pair of electrodes disposed on a first surface of a substrate forming part of a flow path for a liquid. The pair of electrodes are adjacent to each other in a transverse direction of the electrodes, and the liquid moves in the transverse direction upon application of a voltage across the electrodes. The electrodes each include a ridge portion disposed on the first surface and an electrode wiring line connected to a power source for applying the voltage. The electrode wiring line covers an upper surface of the ridge portion and side surfaces of the ridge portion and extends from parts covering the side surfaces of the ridge portion to a downstream side and an upstream side in a direction in which the liquid moves, so as to cover the first surface.

Further features of the present invention will become apparent from the following description of exemplary embodiments with reference to the attached drawings.

DESCRIPTION OF THE EMBODIMENTS

Figure 1:
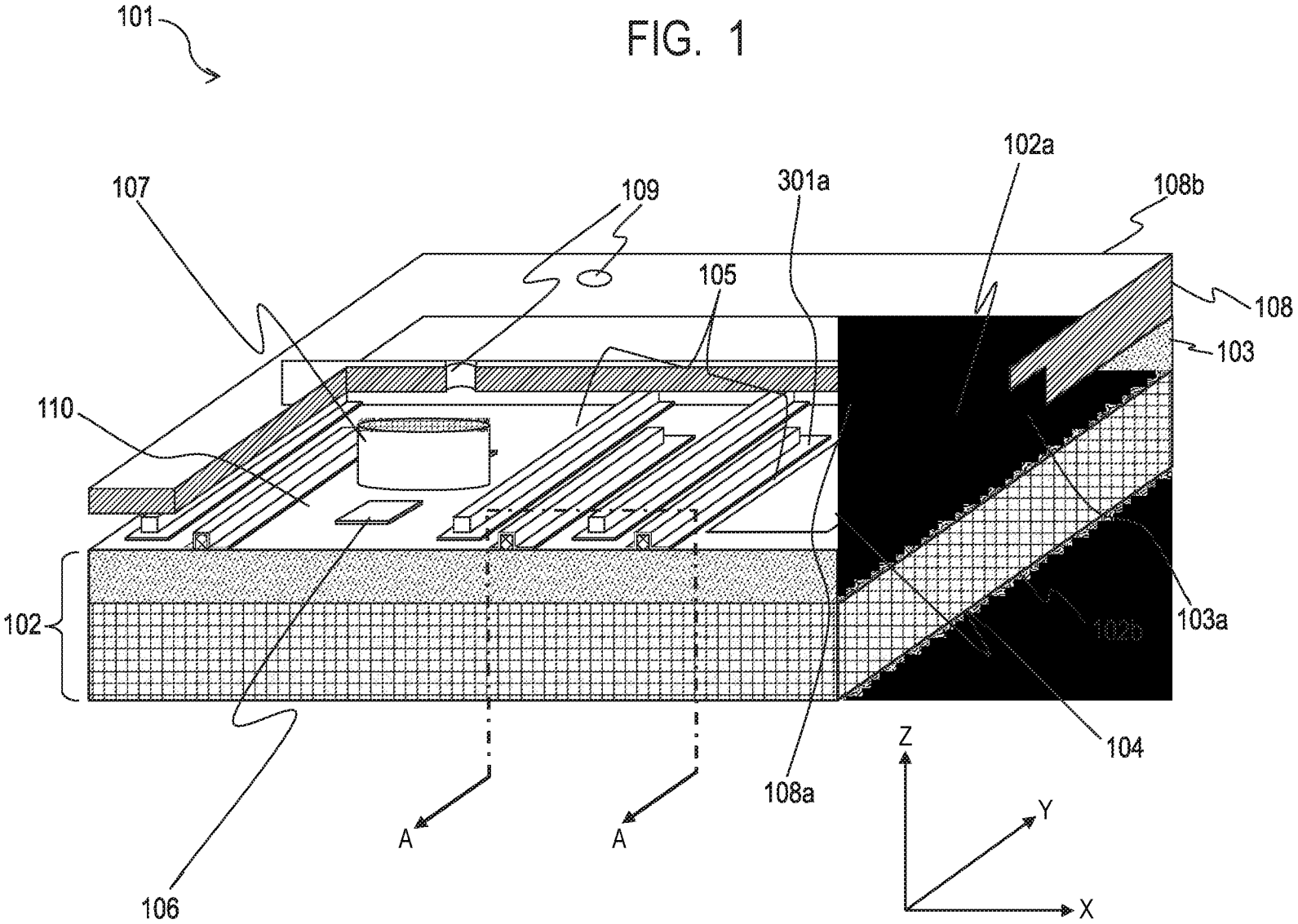
FIG. 1 is a perspective view illustrating an example of a recording element substrate of a liquid ejection head in a first embodiment.

It is found that the long-term use of the three-dimensional electrode pump disclosed in International Publication No. WO2013/130039 degrades adhesion between a substrate and electrode wiring lines and adhesion between the electrode wiring lines and ridge portions, which may cause lifting or peeling of the electrode wiring lines and the ridge portions. In particular, the electrode wiring lines and the ridge portions tend to be peeled on the upstream side of ink flow. This is found to be because of the structure of the three-dimensional electrode pump disclosed in International Publication No. WO2013/130039. The three-dimensional electrode pump disclosed in International Publication No. WO2013/130039 includes ridge portions and electrode wiring lines that cover the upper surfaces, the lower surfaces, and the side surfaces of the ridge portions. This structure needs to be obtained by forming part of the electrode wiring lines on the substrate, then forming ridge portions on the part of the electrode wiring lines, and further forming other part of the electrode wiring lines on the side surfaces and the upper surfaces of the ridge portions. In other words, the electrode wiring lines need to be formed by two-step processing, which makes it difficult to precisely form electrode wiring lines. It is thus found that, in terms of manufacturing method, the long-term use may degrade adhesion between the substrate and the electrode wiring lines and adhesion between the electrode wiring lines and the ridge portions to cause lifting or peeling of the electrode wiring lines and the ridge portions. In light of the foregoing circumstances, there is a need to address various measures for improving adhesion between a substrate and electrode wiring lines and adhesion between electrode wiring lines and ridge portions.

A liquid ejection head and a method for manufacturing the liquid ejection head in embodiments of the present invention will be described below with reference to the drawings. In the following embodiments, an ink jet recording head for ejecting ink, which is an example of the liquid, and a method for manufacturing the ink jet recording head will be described below by way of specific configurations. The present invention, however, is not limited to these specific configurations. The liquid ejection head and a method for manufacturing the liquid ejection head in the present invention can be applied to devices, such as printers, copying machines, facsimile machines with a communication system, word processors with a printing unit, and furthermore industrial recording devices in combination with various processing devices. The liquid ejection head of the present invention can be used in applications where liquid other than ink is ejected, for example, biochip fabrication and electronic circuit printing.

Since the following embodiments are exemplary embodiments to which the present invention is applied, various technically preferred limitations are imposed on the embodiments. However, the present invention is not limited to the embodiments in this specification and other specific methods can be realized without departing from the technical ideas of the present invention.

In the drawings and the following description, the direction X corresponds to the direction parallel to the transverse direction of an electrode, the direction Y corresponds to the direction parallel to the longitudinal direction of the electrode, and the direction Z corresponds to the direction perpendicular to a first surface 102*a* of a substrate 102. The direction X, the direction Y, and the direction Z are perpendicular to one other.

First Embodiment

FIG. 1 is a perspective view illustrating an example of a recording element substrate of a liquid ejection head in a first embodiment. A recording element substrate 101 includes a substrate 102 and an ejection orifice forming member 108. The substrate 102 has a first surface 102*a* and a second surface 102*b* opposite the first surface 102*a*. The substrate 102 includes an insulating film 103, and a first surface 103*a* of the insulating film 103 forms the first surface 102*a* of the substrate 102. The substrate 102 has an ink supply path 104. The ink supply path 104 passes through the substrate 102 in the direction Z from the second surface 102*b* to the first surface 102*a*. The first surface 102*a* of the substrate 102 has plural energy-generating elements 106, which apply energy for ejection to ink. The energy-generating element 106 in this embodiment is a heat-generating element, but the energy-generating element 106 may be a different type of element, such as a piezoelectric element, as long as it can apply energy for ejection to ink. The energy-generating elements 106 form an element array 106*a* disposed in a line in the direction Y (see FIG. 2A). Furthermore the first surface 102*a* of the substrate 102 has plural three-dimensional electrode pumps 105, which move ink through the use of ACEO and circulates the ink in an ink circulation direction (ink moving direction) 401 (see FIG. 2B).

The ejection orifice forming member 108 has a first surface 108*a* and a second surface 108*b* opposite the first surface 108*a*. The first surface 108*a* of the ejection orifice forming member 108 is bonded to the first surface 102*a* of the substrate 102, that is, the first surface 103*a* of the insulating film 103. The ejection orifice forming member 108 includes plural orifices 109 for ejecting ink. The ejection orifice forming member 108 forms plural pressure chambers 110 between the ejection orifice forming member 108 and the first surface 102*a* of the substrate 102. The pressure chamber 110 contains the energy-generating element 106 and is in communication with the ejection orifice 109. The adjacent pressure chambers 110 are separated by a flow path wall 107. Ink is supplied to the pressure chamber 110 from the ink supply path 104, acquires energy for ejection from the energy-generating element 106, and is ejected from the ejection orifice 109.

Figure 2A:
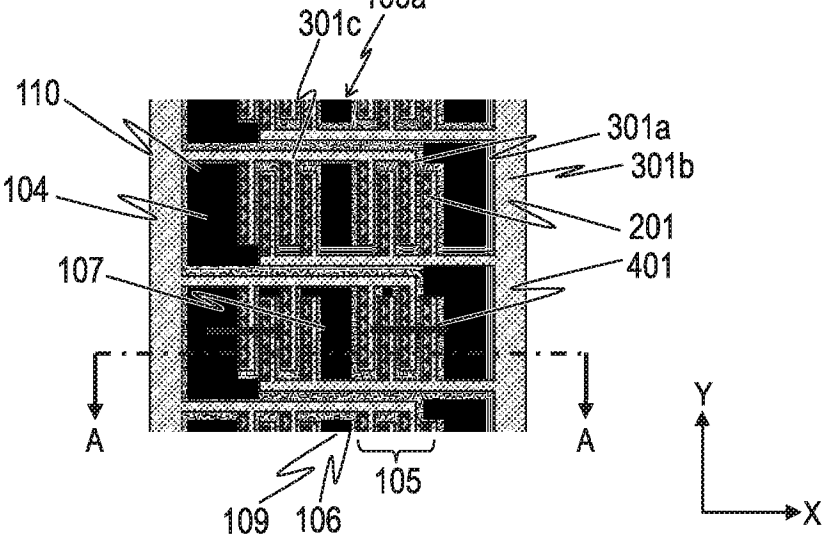
FIGS. 2A, 2B, 2C and 2D are partial detailed views illustrating part of the recording element substrate.
Figure 2B:
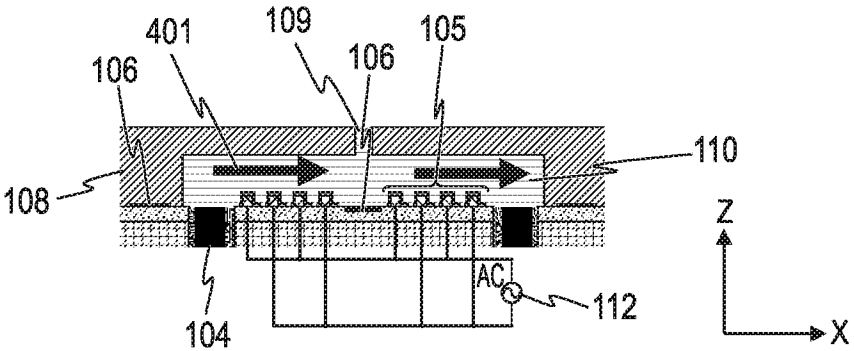
Figure 2C:
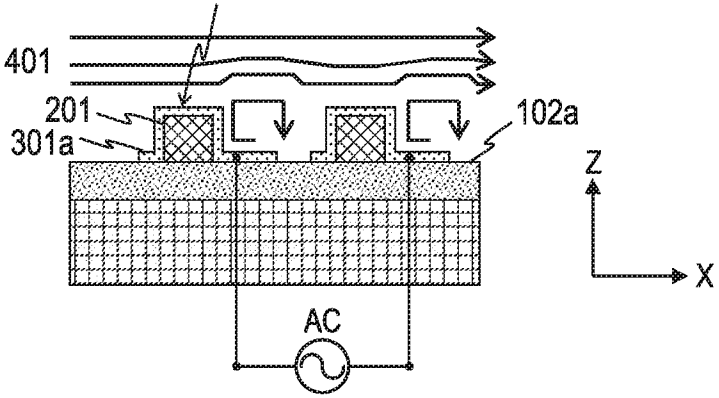
Figure 2D:
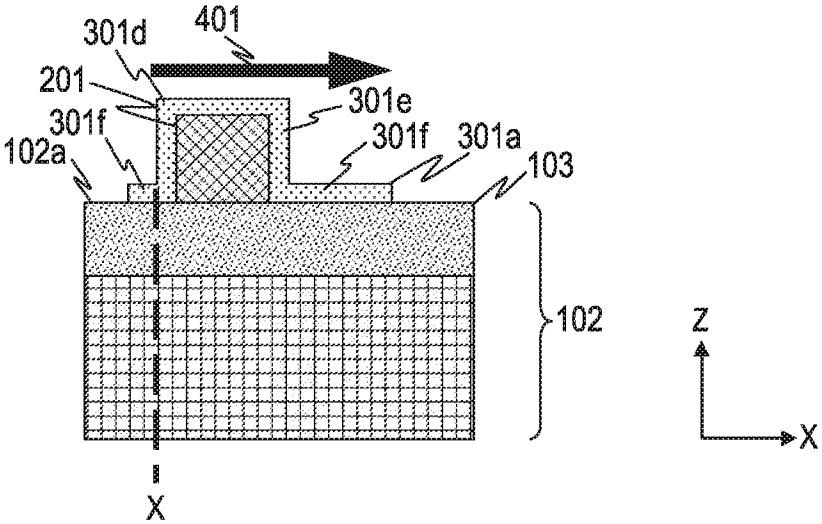

FIG. 2A is a partially enlarged top view of the recording element substrate in this embodiment, where the ejection orifice forming member 108 is not shown. FIG. 2B is a cross-sectional view taken along line A-A in FIG. 2A. FIG. 2C is an enlarged cross-sectional view of FIG. 2B and illustrates the three-dimensional electrode pump and the ink circulation direction in association with ACEO. FIG. 2D is a partially enlarged cross-sectional view of FIG. 2C and illustrates a detailed structure of an electrode including a ridge portion and an electrode wiring line. An ink moving direction 401 is illustrated in FIGS. 2A to 2D. The tail of the arrow corresponds to the upstream side in the ink moving direction, and the head of the arrow corresponds to the downstream side. The three-dimensional electrode pump 105 is disposed on each side of the element array 106*a* in the direction X. In other words, the three-dimensional electrode pump 105 is disposed on each side of the energy-generating element 106 in the ink circulation direction. The three-dimensional electrode pump 105 includes a ridge portion 201 and an electrode 301 including an electrode wiring line 301*a* covering the ridge portion 201. One ridge portion 201 and the electrode 301 covering this ridge portion 201 form one unit 105*a*. The number of units 105*a* is not limited, but one three-dimensional electrode pump 105 includes at least two units 105*a*.

As illustrated in FIGS. 1 and 2A, each of the ridge portions 201 is an elongated structure having a substantially rectangular parallelepiped shape and disposed on the first surface 102*a* of the substrate 102. The ridge portions 201 each has a long axis extending in the direction Y The ridge portions 201 are formed of an insulating material, such as resin (resist). The ridge portions 201 are adjacent to each other at a distance in the direction X and disposed on both sides of the energy-generating element 106 in the direction X. The adjacent ridge portions 201 are slightly displaced from each other in the direction Y The ridge portions 201 are substantially square in the X-Z cross section, but the ridge portions 201 may be quadrilateral, such as rectangular or trapezoidal.

As illustrated in FIG. 2A, the electrode 301 includes an individual wiring line (electrode wiring line) 301*a*, a common wiring line 301*b*, and a connection wiring line 301*c*. The common wiring line 301*b* is disposed on each side of the element array 106*a* and extends in parallel to the longitudinal direction (direction Y) of the ridge portions 201 as viewed in the direction Z. The connection wiring line 301*c* diverges from the common wiring line 301*b* as viewed in the direction Z and extends parallel to the transverse direction (direction X) of the ridge portions 201. The connection wiring line 301*c* is disposed on each side of the ridge portion 201 in the longitudinal direction. Plural individual wiring lines 301*a* diverge from the connection wiring lines 301*c* and extend parallel to the longitudinal direction (direction Y) of the ridge portions 201 so as to form a comb shape. In FIG. 2A, the individual wiring lines 301*a* connected to the common wiring lines 301*b* on the left side alternate with the individual wiring lines 301*a* connected to the common wiring line 301*b* on the right side. The individual wiring lines 301*a* function as electrodes of the three-dimensional electrode pumps 105. In the following description, the individual wiring line 301*a* may be referred to as the electrode wiring line 301*a*. The number and arrangement of the electrodes 301 (electrode wiring lines 301*a*) correspond to the number and arrangement of the ridge portions 201. Therefore, plural elongated electrodes 301 are adjacent to each other in the direction X and extend substantially parallel to each other in the direction Y. In other words, the three-dimensional electrode pump 105 includes at least a pair of electrodes 301 adjacent to each other in the direction X and extending substantially parallel to each other in the direction Y.

The electrode wiring line 301*a* covers the ridge portion 201 and the first surface 102*a* of the substrate 102 around the ridge portion 201. More specifically, as illustrated in FIG. 2D, the electrode wiring line 301*a* has a first portion 301*d* covering the upper surface of the ridge portion 201, a second portion 301*e* covering the side surfaces of the ridge portion 201, and a third portion 301*f* covering the first surface 102*a* of the substrate 102. The third portion 301*f* covering the first surface 102*a* of the substrate 102 extends from the second portion 301*e* covering the side surfaces of the ridge portion 201. The third portion 301*f* extends on the downstream side and the upstream side in the liquid moving direction. In particular, when the third portion 301*f* extends from the side surfaces of the ridge portion 201 to the downstream side and the upstream side in the ink moving direction, the peeling and the like of the electrode wiring layer and the ridge portion are suppressed. In terms of manufacturing method, the first portion 301*d*, the second portion 301*e*, and the third portion 301*f* are formed integrally and continuously because the electrode wiring line 301*a* is formed by one-step processing. The third portion 301*f* is disposed on the downstream side and the upstream side of the ridge portion 201 in the ink circulation direction 401 and covers the first surface 102*a* of the substrate 102. As illustrated in FIG. 2A, the third portion 301*f* covers the first surface 102*a* of the substrate 102 adjacent to both edges of the ridge portion 201 in the direction Y. In other words, the third portion 301*f* extends along the entire edges of the ridge portion 201 in contact with the first surface 102*a* so as to cover the first surface 102*a* adjacent to the edges. The third portion 301*f* is preferably disposed along the entire edges of the ridge portion 201.

The above structure can suppress a deterioration in adhesion between the substrate 102 and the three-dimensional electrode pump 105 even after the long-term use. The first reason is that the third portion 301*f* of the electrode wiring line 301*a* improves adhesion between the first surface 102*a* of the substrate 102 and the ridge portion 201 and between the first surface 102*a* and the electrode wiring line 301*a*. Specifically, the third portion 301*f*, particularly the third portion 301*f* extending on the upstream side in the liquid moving direction, acts so as to press the ridge portion 201 and the electrode wiring line 301*a* against the first surface 102*a*. As a result, the ridge portion 201 and the electrode wiring line 301*a* are unlikely to be peeled from the first surface 102*a*. The second reason is that the second portion 301*e* and the third portion 301*f*, particularly the third portion 301*f* extending on the upstream side in the liquid moving direction, suppress ink penetration into the interface between the first surface 102*a* of the substrate 102 and the ridge portion 201 (this interface is hereinafter referred to simply as an interface). In other words, the interface is sealed by the second portion 301*e* and the third portion 301*f* to suppress ink penetration into the interface and suppress damage to the interface. Furthermore, an upper surface a of the ridge portion 201 is covered by the first portion 301*d* in this embodiment. The pathway for ink penetration into the interface is thus blocked, which makes it further difficult to cause ink to penetrate the interface. Therefore, the adhesion between the substrate 102 and the three-dimensional electrode pump 105 is unlikely to deteriorate even after the long-term use of the liquid ejection head. Moreover, it is difficult to cause peeling and lifting of the electrode wiring line 301*a* and the ridge portion 201, which can prevent low ink flow rate, ejection failure, and the like.

An alternating-current voltage 112, which serves as a power source, is applied to a pair of common wiring lines 301*b*. Therefore, as illustrated in FIGS. 2B and 2C, the alternating-current voltage 112 is applied across the adjacent electrodes 301. An electric potential difference generated between the adjacent electrodes 301 causes ink in contact with the electrodes 301 to be charged. An electrical double layer is formed on the charged surfaces of the electrodes 301. At this time, the Coulomb force acts on ink on the charged surfaces of the electrodes 301 due to an electric field generated between the adjacent electrodes 301. As a result, as illustrated in FIGS. 2A and 2B, a force for moving the ink is generated in the pressure chamber 110 on the basis of the ACED generated by the three-dimensional electrode pump 105. The force for moving the ink is generated in the ink circulation direction 401 (the transverse direction of the electrodes 301), which is a direction (direction X) perpendicular to the longitudinal direction (direction Y) of the electrodes 301. Moreover, as illustrated in FIG. 2C, a spiral flow is generated on the basis of a difference in height between the electrodes 301 formed by the ridge portions 201. This spiral flow enables formation of the three-dimensional electrode pump 105 providing high ink circulation efficiency. As illustrated in FIG. 2D, in this embodiment, the area (length) of a part of the electrode 301 on the downstream side in contact with the first surface 102*a* of the substrate 102 is greater (larger) than that on the upstream side of the electrode 301. An electric potential difference is generated accordingly between the upstream side and the downstream side of the electrode 301. As a result, the electric field distribution on the upstream side of the electrode 301 differs from that on the downstream side. Near the upstream side of the electrode 301, a small rotating vortex with a high flow rate is formed. Near the downstream side of the electrode 301, a small rotating vortex with a low flow rate is formed in a low potential region, and a large rotating vortex with a high flow rate is formed in a high potential region. As a result, the ink is drawn from the upstream side of the electrode 301 to the downstream side, and the ink circulates from the upstream side of the electrode 301 to the downstream side.

Second Embodiment

Figure 3A:
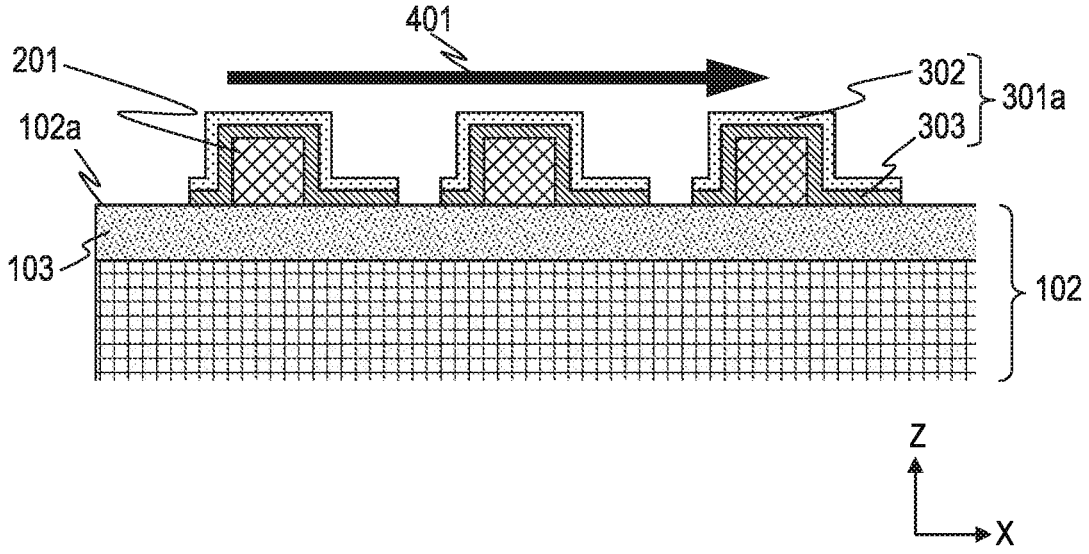
FIGS. 3A and 3B are cross-sectional views of a three-dimensional electrode pump in a second embodiment taken along line A-A in FIG. 1.
Figure 3B:
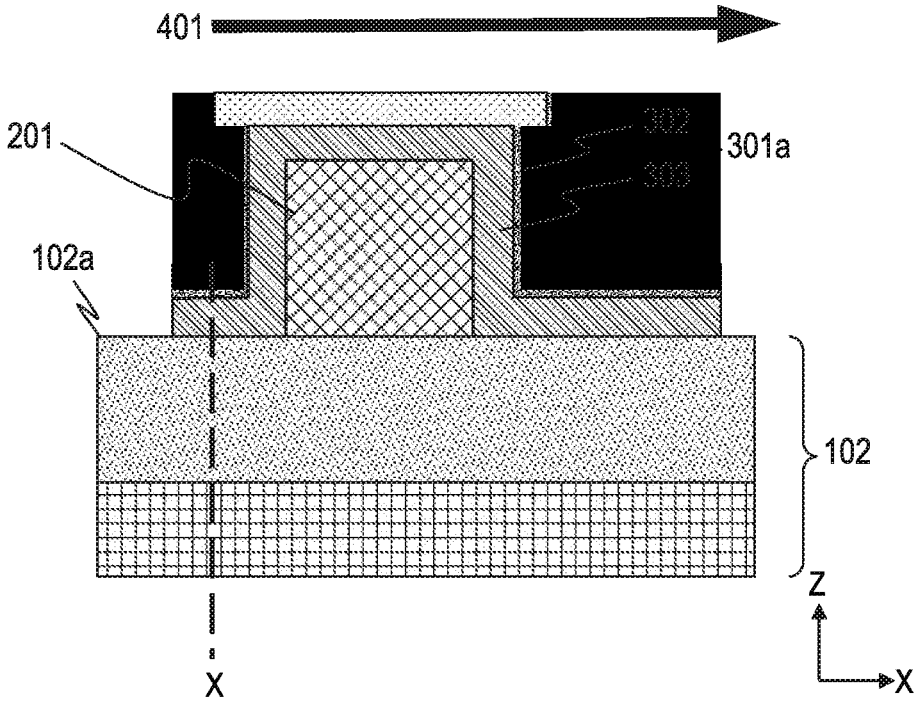

Next, a liquid ejection head in a second embodiment will be described referring to FIGS. 3A and 3B. FIG. 3A is an enlarged cross-sectional view similar to FIG. 2C and illustrates a three-dimensional electrode pump and an ink circulation direction in association with ACEO. FIG. 3B is a partially enlarged cross-sectional view similar to FIG. 2D and illustrates detailed structures of a ridge portion and an electrode. In this embodiment, like the first embodiment, a third portion 301*f* of an electrode wiring line 301*a* is in contact with a first surface 102*a* of a substrate 102 on the downstream side in an ink circulation direction 401. The third portion 301*f* of the electrode wiring line 301*a* is also in contact with the first surface 102*a* of the substrate 102 on the upstream side in the ink circulation direction 401.

The electrode wiring line 301*a* in this embodiment has a multilayer structure in order to obtain both strong adhesion between the first surface 102*a* of the substrate 102 and the ridge portion 201 and high ink resistance. The electrode wiring line 301*a* includes a lower layer wiring portion 303 and an upper layer wiring portion 302. The lower layer wiring portion 303 covers the upper surface and side surfaces of the ridge portion 201 and the first surface 102*a*. The upper layer wiring portion 302 covers the surfaces of the lower layer wiring portion 303 that are opposite the surfaces covering the upper surface and side surfaces of the ridge portion 201 and the first surface 102*a*. The lower layer wiring portion 303 is formed of a metal material containing at least one material selected from Ti, W, Ta, Ni, and Cr, which provide strong adhesion between the lower layer wiring portion 303 and the first surface 102*a* of the substrate 102. The lower layer wiring portion 303 preferably has a thickness of 200 nm or more in order to improve covering performance on the ridge portion 201. The upper layer wiring portion 302 is formed of a metal material containing at least one material selected from Au, Pt, Ir, Ru, Ag, Bi, Pd, and Os, which have high ink resistance, that is, high corrosion resistance against ink. The use of this structure makes it easy to obtain both the adhesion between the electrode wiring line 301*a* and the ridge portion 201 and the resistance of the electrode wiring line 301*a* against ink compared with the first embodiment.

Furthermore, according to this embodiment, connection terminals 113 (see FIG. 4C) provided at the common wiring lines 301*b* to externally apply an alternating-current voltage 112 to the individual wiring lines 301*a* may be formed of a multilayer film having the lower layer wiring portion 303 and the upper layer wiring portion 302. The upper layer wiring portion 302 functions as a surface stable film that protects the connection terminal 113 from oxidation or the like. The lower layer wiring portion 303 functions as a diffusion preventing film that suppresses diffusion of the metal of the upper layer wiring portion 302 into an electroconductive base layer (not shown).

Figure 4A:
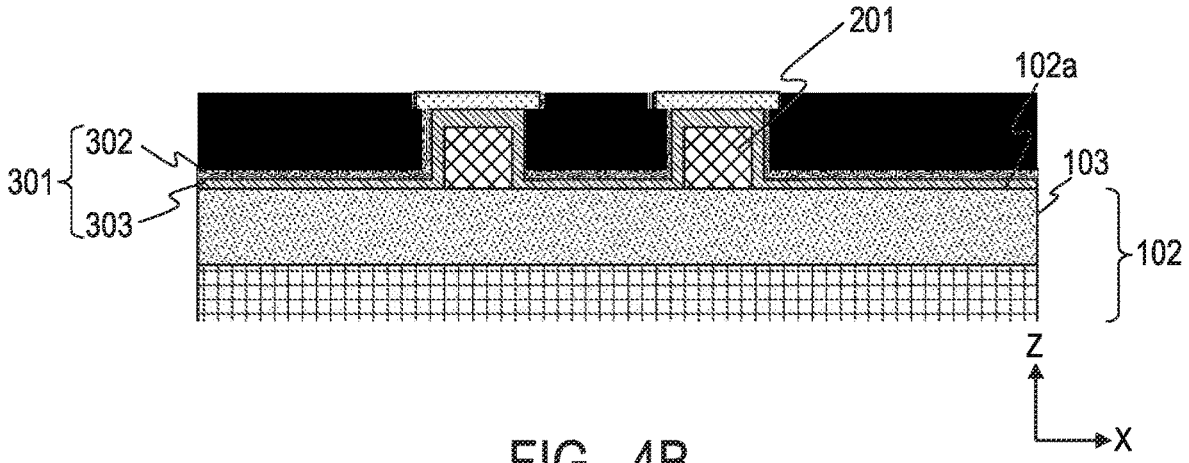
FIGS. 4A, 4B and 4C are cross-sectional views illustrating the processes for manufacturing the three-dimensional electrode pump in the second embodiment.
Figure 4B:
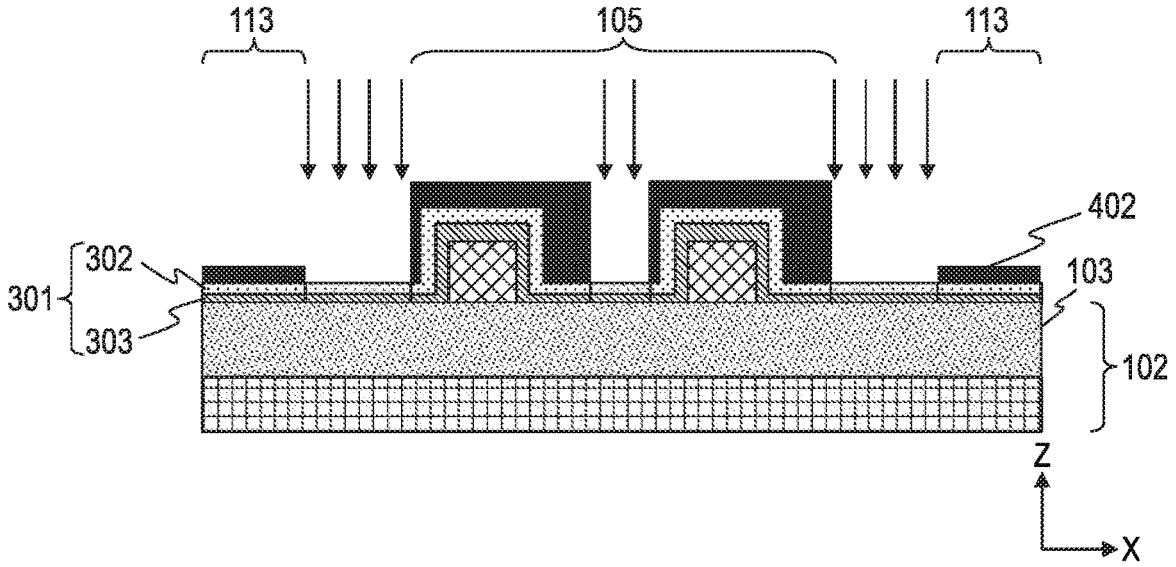
Figure 4C:
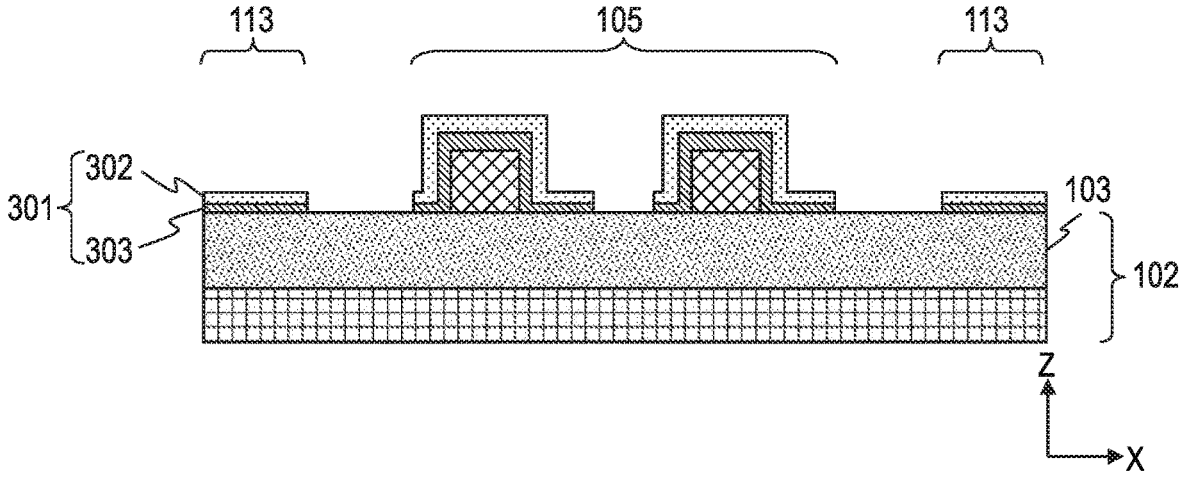

Next, referring to FIGS. 4A to 4C, a method for manufacturing a three-dimensional electrode pump in a second embodiment will be described. FIGS. 4A to 4C are cross-sectional views illustrating the processes for manufacturing the three-dimensional electrode pump. First, as illustrated in FIG. 4A, an electrode wiring layer 301 is formed on a first surface 102*a* of a substrate 102 and ridge portions 201 by using a sputtering apparatus or the like. Next, as illustrated in FIG. 4B, a resin (resist) 402 that has been patterned into a shape covering connection terminals 113 and a three-dimensional electrode pump 105 is provided, and the electrode wiring layer 301 is etched. The three-dimensional electrode pump 105 illustrated in FIG. 4C is obtained accordingly. In this embodiment, the three-dimensional electrode pump 105 and the connection terminals 113 can be formed in the same process, which can reduce the number of manufacturing processes. Therefore, a recording element substrate 101 having the three-dimensional electrode pump 105 mounted thereon can be manufactured with low costs.

Third Embodiment

Figure 5A:
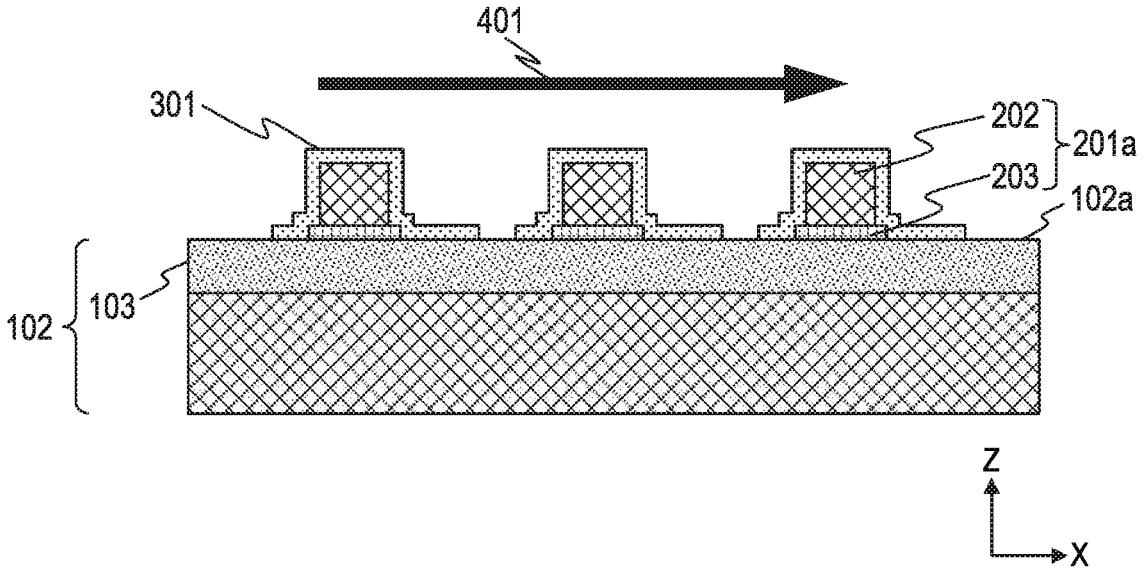
FIGS. 5A and 5B are cross-sectional views of a three-dimensional electrode pump in a third embodiment taken along line A-A in FIG. 1.
Figure 5B:
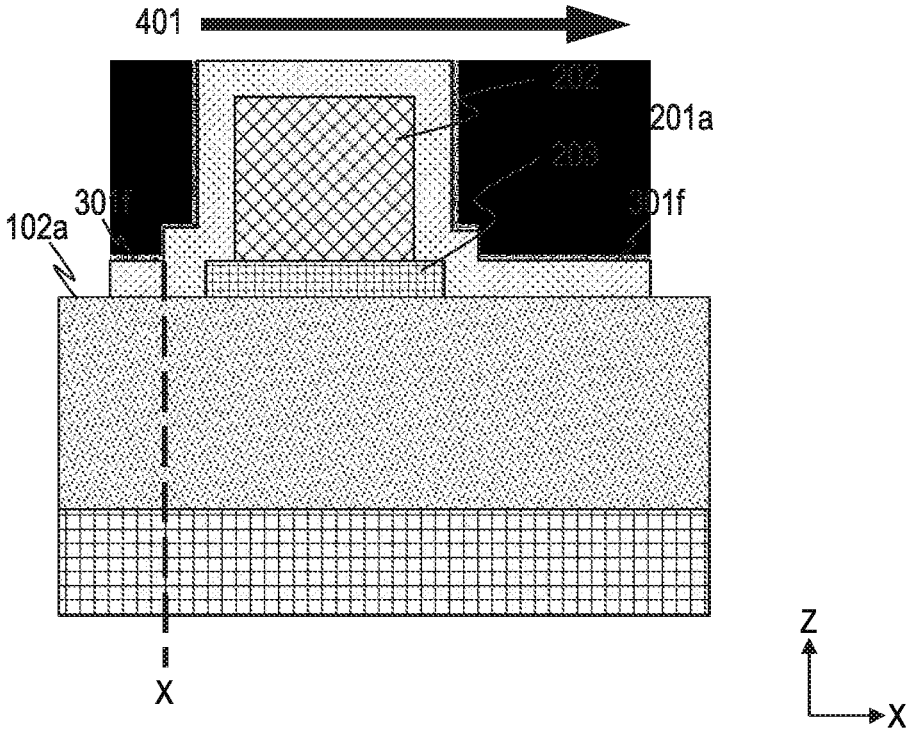

Next, referring to FIGS. 5A and 5B, a three-dimensional electrode pump in a third embodiment will be described. FIG. 5A is an enlarged cross-sectional view similar to FIG. 2C and illustrates a three-dimensional electrode pump and an ink circulation direction in association with ACEO. FIG. 5B is a partially enlarged cross-sectional view similar to FIG. 2D and illustrates detailed structures of a ridge portion and an electrode. In this embodiment, like the first embodiment, a third portion 301*f* of an electrode wiring line 301*a* is in contact with a first surface 102*a* of a substrate 102 on the downstream side in an ink circulation direction 401, and the third portion 301*f* is in contact with the first surface 102*a* of the substrate 102 on the upstream side in the ink circulation direction 401.

A ridge portion 201*a* in this embodiment has a multilayer structure in order to obtain both strong adhesion between the ridge portion 201*a* and the substrate 102, which is a base, and a function of forming a large step. The ridge portion 201*a* includes a lower layer ridge portion 203 and an upper layer ridge portion 202. The lower layer ridge portion 203 adheres to the first surface 102*a* of the substrate 102. The upper layer ridge portion 202 is disposed on a surface of the lower layer ridge portion 203 that is opposite a surface adhering to the first surface 102*a* of the substrate 102. The lower layer ridge portion 203 is formed of an organic material exhibiting strong adhesion and may be formed of, for example, polyamide. The upper layer ridge portion 202 is formed of a resin (resist material) and may be formed of, for example, SU-8. Resin exhibits high heat resistance and strong adhesion and has an ability to form large steps because resin can be finely processed into high aspect ratio by using photolithography.

The adhesion strength between the ridge portion 201*a* and the substrate 102 is improved by employing such a configuration. The ability of the ridge portion 201*a* to form a large step is also improved. Therefore, the adhesion strength between the substrate 102 and the ridge portion 201*a* is unlikely to deteriorate even after the long-term use of the liquid ejection head. Moreover, it is difficult to cause peeling and lifting of the ridge portion 201*a*, which can prevent low ink flow rate, ejection failure, and the like.

In FIGS. 5A and 5B, the upper layer ridge portion 202 and the lower layer ridge portion 203 have a rectangular cross section as viewed in the longitudinal direction. As illustrated in FIGS. 5A and 5B, the dimension of the lower layer ridge portion 203 in this cross section is preferably larger than the dimension of the upper layer ridge portion 202 in order to improve the covering performance of the electrode wiring line 301*a*. The adhesion strength between the electrode wiring line 301*a* and the ridge portion 201*a* is improved by employing such a configuration. Therefore, the adhesion strength between the substrate 102 and the ridge portion 201*a* is unlikely to deteriorate even after the long-term use of the liquid ejection head. Moreover, it is difficult to cause peeling and lifting of the ridge portion 201*a*, which can prevent low ink flow rate, ejection failure, and the like. In the longitudinal direction of the upper layer ridge portion 202 and the lower layer ridge portion 203, the dimension of the lower layer ridge portion 203 is also preferably larger than the dimension of the upper layer ridge portion 202.

Modification

Figure 6:
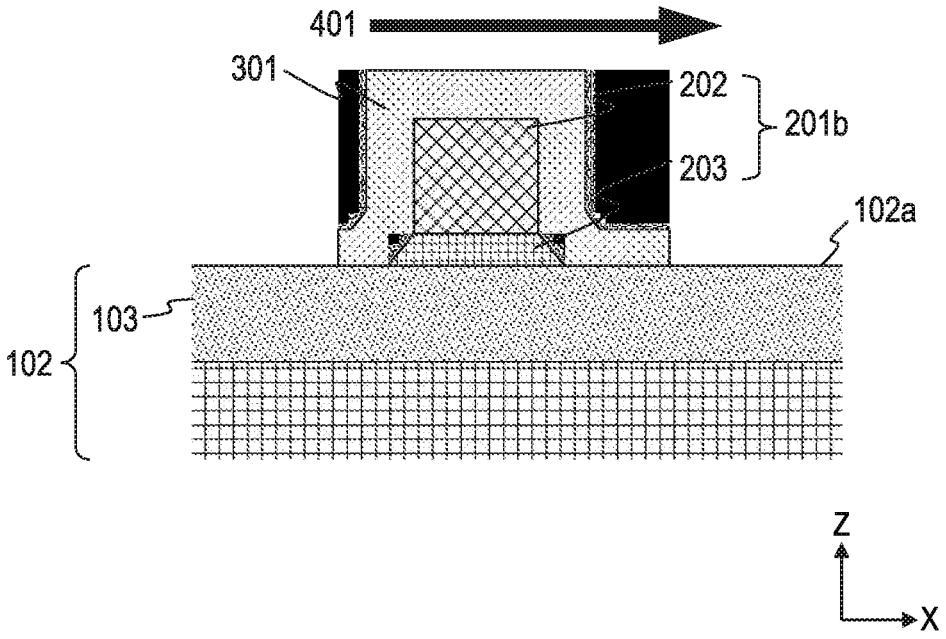
FIG. 6 is an enlarged cross-sectional view of a three-dimensional electrode pump in a modification of the third embodiment.

Next, referring to FIG. 6, a three-dimensional electrode pump in a modification of this embodiment will be described. FIG. 6 is an enlarged cross-sectional view of the three-dimensional electrode pump in the modification of this embodiment. As illustrated in FIG. 6, the dimension, in an ink circulation direction 401, of a surface of a lower layer ridge portion 203 that is in contact with a first surface 102*a* of a substrate 102 is larger than the dimension, in the ink circulation direction 401, of a surface in contact with the bottom surface of an upper layer ridge portion 202 in order to improve the covering performance of the electrode wiring line 301*a*. In other words, the lower layer ridge portion 203 preferably has a trapezoidal cross section with a long side adjacent to the substrate 102 and a short side adjacent to the upper layer ridge portion 202 as viewed in the longitudinal direction (direction Y) of a three-dimensional electrode pump 105 (the upper layer ridge portion 202 and the lower layer ridge portion 203). The adhesion strength between the electrode wiring line 301*a* and a ridge portion 201*b* can be improved by employing such a configuration. In the longitudinal direction, the dimension of the surface of the lower layer ridge portion 203 that is in contact with the first surface

102*a* of the substrate 102 is also preferably larger than the dimension in contact with the bottom surface of the upper layer ridge portion 202.

Method for Manufacturing Three-Dimensional Electrode Pump in Modification

Next, referring to FIGS. 7A to 7F, a method for manufacturing the three-dimensional electrode pump in the modification will be described. FIGS. 7A to 7E are cross-sectional views illustrating the processes for manufacturing the three-dimensional electrode pump in the modification. FIG. 7F is a cross-sectional view of a substrate of a liquid ejection head in the modification provided with an ejection orifice forming member 108 on the substrate.

Figure 7A:
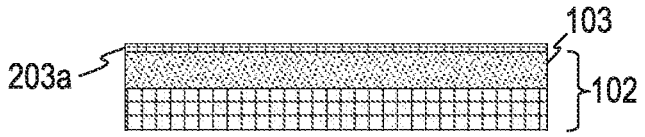
FIGS. 7A, 7B, 7C, 7D, 7E and 7F are cross-sectional views illustrating the processes for manufacturing the three-dimensional electrode pump in the modification of the third embodiment.
Figure 7B:
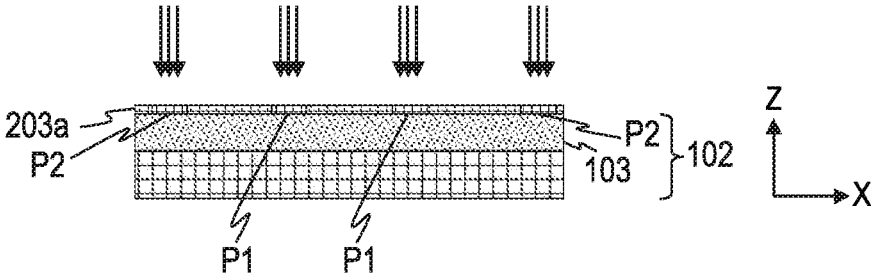

As illustrated in FIG. 7A, a first resin film 203*a*, which will serve as lower layer ridge portions 203, is formed on a first surface 102*a* of a substrate 102 including an insulating film 103 by coating using a spin coater or the like. Next, as illustrated in FIG. 7B, exposure is performed by using an exposure device to convert the first resin film 203*a* into a latent image. In the conversion of the first resin film 203*a* into a latent image, the following exposure process is performed. Specifically, first portions P1, which will serve as adhesion improving films between ridge portions 201 and the substrate 102, and second portions P2, which will serve as adhesion improving films between the ejection orifice forming member 108 (FIG. 1) and the substrate 102, are exposed together at the same time.

Figure 7C:
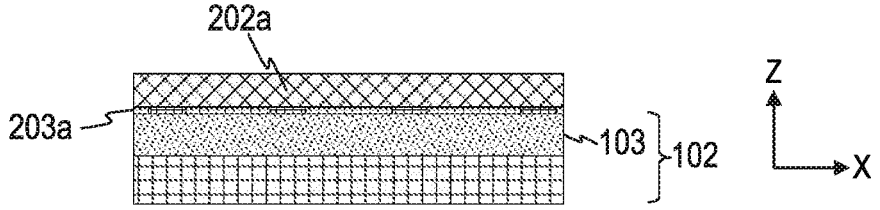
Figure 7D:
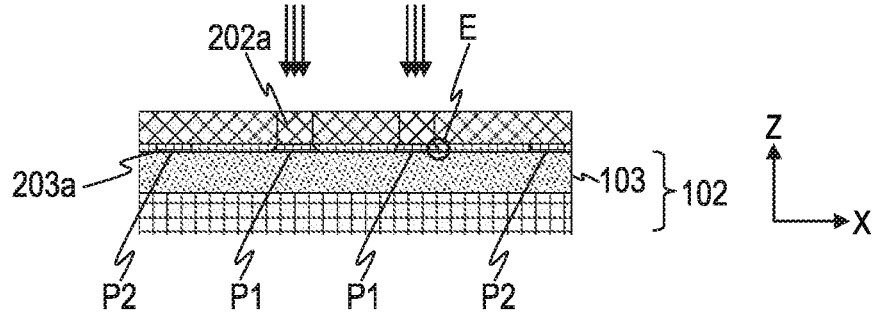

Next, as illustrated in FIG. 7C, a second resin film 202*a*, which will serve as upper layer ridge portions 202, is formed on the first resin film 203*a* by coating using a dry film laminate or the like. In this state, as illustrated in FIG. 7D, the first portions P1 of the second resin film 202*a* are exposed by using an exposure device. When the first resin film 203*a* is made of a material having higher exposure sensitivity than the material of the second resin film 202*a*, side regions E located on the side of the first portions P1 of the first resin film 203*a* in the direction X are additionally exposed in a defocused state by using leak light. Thus, the dimension, in the ink circulation direction 401, of a surface of the lower layer ridge portion 203 that is in contact with the first surface 102*a* of the substrate 102 can be made larger than the dimension, in the ink circulation direction 401, of a surface in contact with the bottom surface of the upper layer ridge portion 202.

Figure 7E:
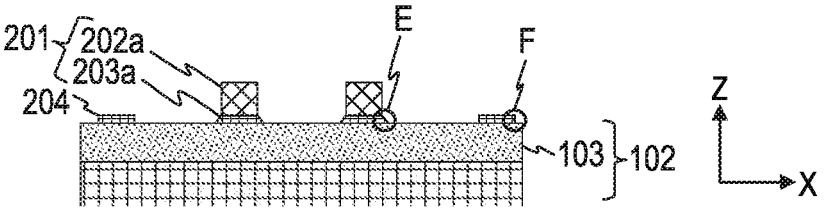
Figure 7F:
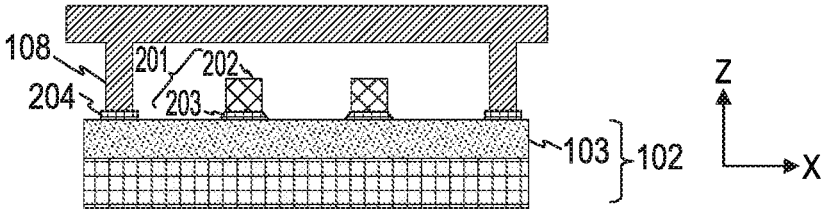

Next, as illustrated in FIG. 7E, ridge portions 201 are formed by developing the first resin film 203*a* and the second resin film 202*a* together. The shape of the lower layer ridge portions 203 can be controlled by performing the exposure described in FIG. 7D in such a manner that the side regions E have a substantially tapered shape and side regions F located on the side of the second portions P2 of the first resin film 203*a* in the direction X have a vertical shape. When the side regions E of the lower layer ridge portions 203 have a substantially tapered shape, as described in FIG. 6, the covering performance of the electrode wiring line 301*a* can be improved. When the side regions F have a vertical shape, as illustrated in FIG. 7F, the ejection orifice forming member 108 can be formed on the substrate 102 with high dimensional accuracy.

As described in FIG. 7B, the first portions P1 and the second portions P2 are formed by using the same process to reduce the number of manufacturing processes. As described in FIG. 7E, the second resin film 202*a* and the side regions E of the lower layer ridge portions 203 are exposed in the same process to reduce the number of manufacturing processes. Furthermore, as described in FIG. 7D, light striking the side regions E of the lower layer ridge portions 203 directly below the second resin film 202*a* is out of focus in the exposure of the second resin film 202*a*, which allows the lower layer ridge portions 203 to have a stable shape. Therefore, a recording element substrate 101 having the three-dimensional electrode pump 105 mounted thereon can be manufactured so as to have a stable shape with low costs.

Example 1

Figure 8A:
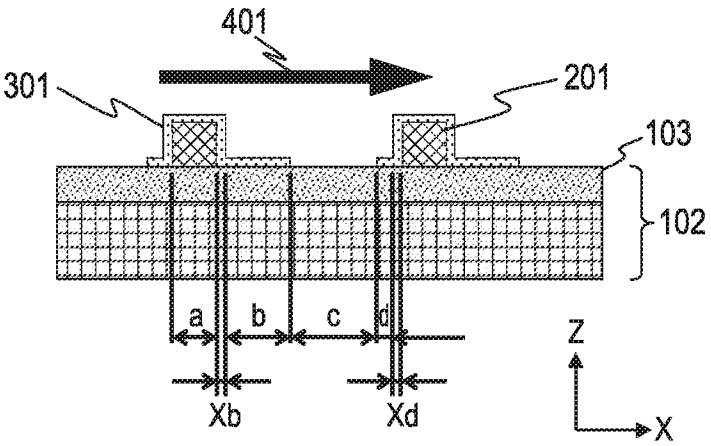
FIGS. 8A, 8B, 8C and 8D are cross-sectional views of three-dimensional electrode pumps in Examples and Comparative Examples.
Figure 8B:
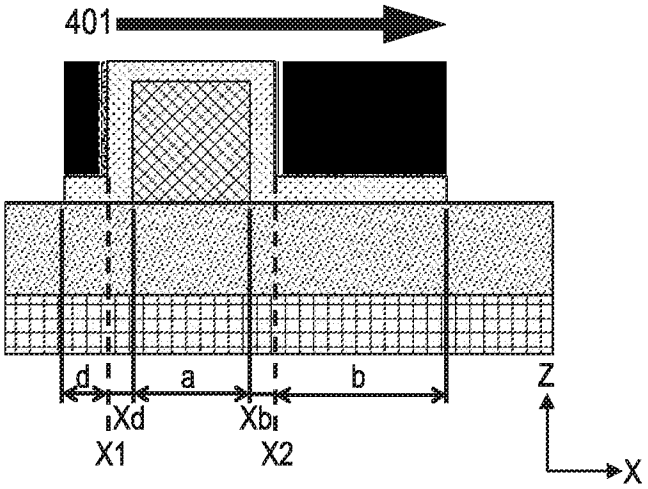
Figure 8C:
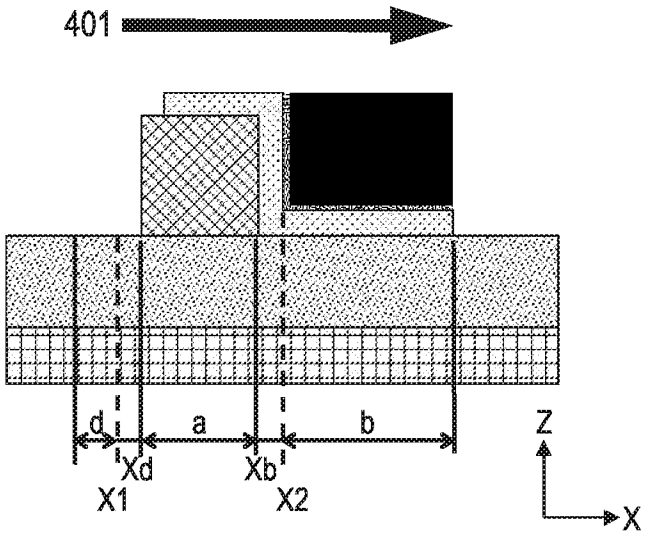
Figure 8D:
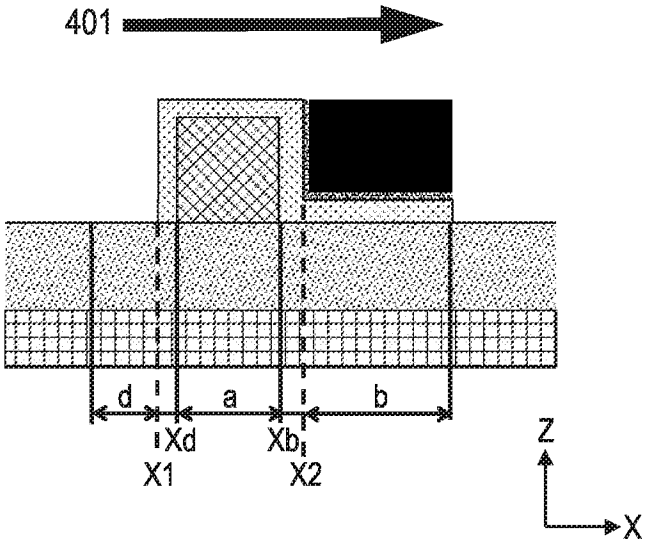

Three-dimensional electrode pumps 105 in Example 1-1, Comparative Example 1-1, and Comparative Example 1-2 were each formed on a first surface 102*a* of a substrate 102, and an ink immersion test was performed. FIG. 8A is a cross-sectional view of the three-dimensional electrode pump in Example 1-1. FIG. 8B is a partially enlarged cross-sectional view of FIG. 8A. FIG. 8C is a partially enlarged cross-sectional view of Comparative Example 1-1 similar to FIG. 8B. FIG. 8D is an enlarged cross-sectional view of Comparative Example 1-2 similar to FIG. 8B.

In the three-dimensional electrode pump 105 in Example 1-1, a ridge portion 201 having a film thickness of 5 μm and formed of an epoxy resin is covered with an electrode wiring line 301*a* having a film thickness of 200 nm and formed of Au. The dimension a of the ridge portion 201 in the direction X, the dimension b of the electrode wiring line 301*a* in the direction X, and the distance c between adjacent electrode wiring lines 301*a* in the direction X were 5 μm. As illustrated in FIGS. 8B to 8D, the dimension b in the direction X was measured by using, as a starting point, a position X2 downstream of a side wall of the ridge portion 201 at a distance equal to a film thickness dimension Xb of the electrode wiring line 301*a* covering the downstream side in an ink circulation direction 401. Similarly, the width dimension d was measured by using, as a starting point, a position X1 upstream of a side wall of the ridge portion 201 at a distance equal to a film thickness dimension Xd of the electrode wiring line 301*a* covering the upstream side in the ink circulation direction 401.

As shown in Table 1, the ink immersion test was performed on samples by changing the width dimension d. In the ink immersion test, each sample in the form of small pieces was stored in a steam chamber filled with steam while the sample was immersed in ink, and the change of the sample was observed after immersion for 10 hours in the steam chamber at 120° C. Two types of ink described below were used. Ink A was a solution formed by mixing water and suitable amounts of organic solvents (2-pyrrolidone, 1,2-hexanediol, polyethylene glycol, and acetylene). Ink B was a pigment black ink (PGI-2300 BK) contained in a Canon ink cartridge.

The resistance evaluation in the ink immersion test was performed by observing the interface state between the ridge portion 201 and the substrate 102 with an electron microscope and determining resistance level on the basis of the following criteria.

Level A: There is no defect in the observed interface.

Level B: There is lifting or peeling in part of the observed interface.

Level C: There is missing of part of the target member.

TABLE 1

| | d | Determination Results Interface Between Ridge Portion 201 and Substrate 102 | |
|---|---|---|---|
| | | Ink A | Ink B |
| Comparative Example 1-1 | −1 mm | C | C |
| Comparative Example 1-2 | 0 mm | B | C |
| Example 1-1 | 1 mm | A | C |

In Comparative Example 1-1 and Comparative Example 1-2, lifting or peeling (level B) or missing (level C) of the ridge portion 201 was found in part of the interface between the ridge portion 201 and the substrate 102 in the ink immersion test. In the ink immersion test using ink A for Example 1-1 with a dimension d of 1 μm in the direction X, there was no defect (level A) in the interface between the ridge portion 201 and the substrate 102, and the ability to improve interface adhesion was observed.

Example 2

Figure 9:
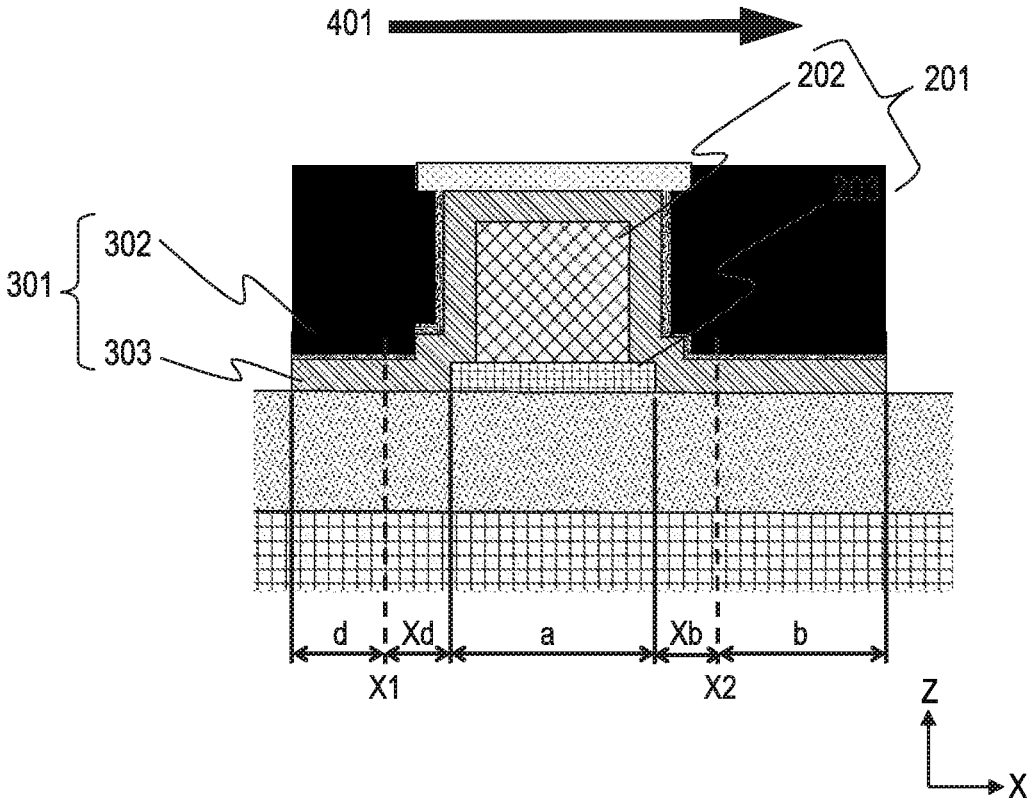
FIG. 9 is an enlarged cross-sectional view in Example 2-1 to Example 2-5.

Next, three-dimensional electrode pumps 105 in Example 2-1 to Example 2-5 were each formed on a first surface 102*a* of a substrate 102, and an ink immersion test was performed. FIG. 9 is an enlarged cross-sectional view of FIG. 8A in Example 2-1 to Example 2-5.

In the three-dimensional electrode pumps 105 in Examples, as illustrated in FIG. 9, an upper layer ridge portion 202 is formed on a lower layer ridge portion 203, and these ridge portions are covered with an electrode 301 including a lower layer wiring portion 303 and an upper layer wiring portion 302. The width dimension a of the lower layer ridge portion 203 and the width dimension b of the upper layer wiring portion 302 on the downstream side in an ink circulation direction 401 were 5 μm. The width dimension d of the upper layer wiring portion 302 on the upstream side in the ink circulation direction 401 was 1 μm. As shown in Table 2, the film thickness of the upper layer wiring portion 302 formed of Au was 200 nm, and the film thickness of the upper layer ridge portion 202 formed of an epoxy resin was 5 μm. The ink immersion test was performed on samples where the lower layer wiring portion 303 formed of TiW had a different film thickness and the lower layer ridge portion 203 formed of a polyether amide resin composition (trade name: HIMAL (registered trademark) available from Hitachi Chemical Company, Ltd.) had a different film thickness.

In the ink immersion test, each sample in the form of small pieces was stored in a steam chamber filled with steam while the sample was immersed in two types of ink which were the same as those in Example 1, and the change of the sample was observed after immersion for 40 hours in the steam chamber at 120° C.

The resistance evaluation in the ink immersion test was performed by observing the interface state between the electrode wiring line 301*a* and the ridge portion 201 and the interface state between the ridge portion 201 and the substrate 102 with an electron microscope and determining resistance level on the basis of the following criteria.

Level A: There is no defect in the observed interface.

Level B: There is lifting or peeling in part of the observed interface.

Level C: There is missing of part of the target member.

TABLE 2

| | Electrode 301a | | Ridge Portion 201 | | Determination Results | | | |
|---|---|---|---|---|---|---|---|---|
| | Film Thickness of Upper Layer 302 | Film Thickness of Lower Layer 303 | Film Thickness of Upper Layer 202 | Film Thickness of Lower Layer 203 | Interface Between Electrode 301a and Ridge Portion 201 | | Interface Between Ridge Portion 201 and Substrate 102 | |
| | (nm) | (nm) | (μm) | (μm) | Ink A | Ink B | Ink A | Ink B |
| Example 2-1 | 200 | — | 5 | — | C | C | B | C |
| Example 2-2 | 200 | 100 | 5 | — | A | C | A | B |
| Example 2-3 | 200 | 200 | 5 | — | A | A | A | B |
| Example 2-4 | 200 | — | 5 | 1 | C | C | A | A |
| Example 2-5 | 200 | 200 | 5 | 1 | A | A | A | A |

In Example 2-1, lifting or peeling (level B) or missing (level C) was found in the interface between the electrode wiring line 301*a* and the ridge portion 201 and the interface between the ridge portion 201 and the substrate 102 in the ink immersion test.

In the ink immersion test using ink A for Example 2-2 where the lower layer wiring portion 303 had a film thickness of 100 nm, there was no defect (level A) in the interface between the electrode wiring line 301*a* and the ridge portion 201 and the interface between the ridge portion 201 and the substrate 102, and the ability to improve interface adhesion was observed.

In the ink immersion test using ink B for Example 2-3 where the lower layer wiring portion 303 had a film thickness of 200 nm, there was no defect (level A) in the interface between the electrode wiring line 301*a* and the ridge portion 201, and the ability to improve interface adhesion was observed.

In the ink immersion test for Example 2-4 where a polyether amide resin composition was provided on the lower layer wiring portion 303, there was no defect (level A) in the interface between the ridge portion 201 and the substrate 102, and the ability to improve interface adhesion was observed.

In the ink immersion test for Example 2-5 where the lower layer wiring portion 303 and the lower layer ridge portion respectively had a film thickness of 200 nm and 1 μm, there was no defect (level A) in the interface between the electrode wiring line 301*a* and the ridge portion 201 and the interface between the ridge portion 201 and the substrate 102, and the ability to improve interface adhesion was observed.

Referring to FIG. 8A, the relationship between the width dimension b of the electrode wiring line 301*a* on the downstream side in the ink circulation direction 401 and the width dimension d on the upstream side will be specifically described. In the present invention, the electrode wiring line 301*a* extends on the upstream side in order to improve adhesion. In other words, d>0. If d is too large, the flow rate of a rotating vortex that rotates in the reverse direction from a rotating vortex generated on the downstream side of the electrode wiring line 301*a* is accelerated. As a result, the rotating vortex generated on the downstream side of the electrode wiring line 301*a* is offset, and the function as a pump is degraded. Therefore, preferably d<b. More preferably, d/b is 0.05 or more and 0.5 or less. Still more preferably, d/b is 0.1 or more and 0.2 or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-207265, filed Nov. 2, 2018, which is hereby incorporated by reference herein in its entirety.

What is claimed is:

1. A liquid ejection head comprising: a substrate having a first surface; and a pair of electrodes disposed on the first surface, the first surface forming part of a flow path for a liquid, the pair of electrodes being adjacent to each other in a transverse direction of the electrodes, the liquid moving in the transverse direction of the electrodes upon application of a voltage across the electrodes, wherein the electrodes each include:

a ridge portion on the first surface, and an electrode wiring line connected to a power source for applying the voltage, and the electrode wiring line covers an upper surface of the ridge portion and side surfaces of the ridge portion, extends from parts covering the side surfaces of the ridge portion to a downstream side and an upstream side with respect to a direction in which the liquid moves, and covers part of the first surface.

2. The liquid ejection head according to claim 1, wherein the electrode wiring line includes a lower layer wiring portion and an upper layer wiring portion covering the lower layer wiring portion, the lower layer wiring portion has higher adhesion to the first surface than the upper layer wiring portion, and the upper layer wiring portion has higher corrosion resistance against the liquid than that of the lower layer wiring portion.

3. The liquid ejection head according to claim 2, wherein the lower layer wiring portion is formed of a metal material containing at least one material selected from the group consisting of Ti, W, Ta, Ni, and Cr, and the upper layer wiring portion is formed of a metal material containing at least one material selected from the group consisting of Au, Pt, Ir, Ru, Ag, Bi, Pd, and Os.

4. The liquid ejection head according to claim 2, further comprising a pair of connection terminals respectively connected to the pair of the electrodes to apply the voltage across the pair of electrodes, wherein each of the pair of connection terminals is formed of same materials as the lower layer wiring portion and the upper layer wiring portion.

5. The liquid ejection head according to claim 1, wherein the ridge portion includes a lower layer ridge portion adhering to the first surface and an upper layer ridge portion disposed on a surface of the lower layer ridge portion, the surface being opposite a surface adhering to the first surface, the lower layer ridge portion has higher adhesion to the first surface than that of the upper layer ridge portion, and the upper layer ridge portion is formed of a resin.

6. The liquid ejection head according to claim 5, wherein the lower layer ridge portion and the upper layer ridge portion have a rectangular cross section as viewed in a longitudinal direction of the lower layer ridge portion and the upper layer ridge portion, and a dimension of the lower layer ridge portion in the transverse direction is larger than a dimension of the upper layer ridge portion in the transverse direction.

7. The liquid ejection head according to claim 5, wherein the lower layer ridge portion has a trapezoidal cross section as viewed in a longitudinal direction of the lower layer ridge portion and the upper layer ridge portion, and a dimension, in the transverse direction, of a surface of the lower layer ridge portion in contact with the first surface is larger than a dimension, in the transverse direction, of a surface of the lower layer ridge portion in contact with a bottom surface of the upper layer ridge portion.

8. The liquid ejection head according to claim 1, wherein d<b is satisfied, where b represents a width dimension of the electrode wiring line covering the first surface and extending on the downstream side, and d represents a width dimension of the electrode wiring line covering the first surface and extending on the upstream side.

9. The liquid ejection head according to claim 8, wherein b and d satisfy d/b of 0.05 or more and 0.5 or less.

10. The liquid ejection head according to claim 8, wherein b and d satisfy d/b of 0.1 or more and 0.2 or less.

* * * * *